US006059944A

United States Patent [19]

DuBois et al.

[11] Patent Number: 6,059,944

[45] Date of Patent: May 9, 2000

[54] DIAPHRAGM FOR ELECTROLYTIC CELL

[75] Inventors: Donald W. DuBois, Irwin; Bernard A. Maloney, Murrysville; Jerry N. Kinney, Harrison City, all of Pa.

[73] Assignee: PPG Industries Ohio, Inc., Cleveland, Ohio

[21] Appl. No.: 09/124,441

[22] Filed: Jul. 29, 1998

[51] Int. Cl.[7] ..... C25B 13/06

[52] U.S. Cl. ..... 204/296; 204/252; 204/283; 204/290 F; 427/243; 427/245; 427/247; 427/295

[58] Field of Search ..... 427/243, 247, 427/245, 295; 204/295, 296, 283, 290 F, 252

[56] References Cited

U.S. PATENT DOCUMENTS

| | | | |
|---|---|---|---|
| 4,036,729 | 7/1977 | Patil et al. | 204/296 |
| 4,126,536 | 11/1978 | Balko et al. | 204/296 |
| 4,170,537 | 10/1979 | Simmons | 204/295 |
| 4,170,538 | 10/1979 | Simmons | 204/295 |
| 4,170,539 | 10/1979 | Simmons | 204/295 |
| 4,210,515 | 7/1980 | Patil et al. | 204/266 |
| 4,606,805 | 8/1986 | Bon | 204/296 |
| 4,680,101 | 7/1987 | Darlington et al. | 204/295 |
| 4,720,334 | 1/1988 | DuBois et al. | 204/296 |
| 4,853,101 | 8/1989 | Hruska et al. | 204/296 |
| 5,030,403 | 7/1991 | Pickens et al. | 264/140 |
| 5,188,712 | 2/1993 | Dilmore et al. | 204/98 |
| 5,192,401 | 3/1993 | DuBois et al. | 204/98 |
| 5,567,298 | 10/1996 | DuBois et al. | 205/350 |
| 5,612,089 | 3/1997 | Dilmore, Jr. et al. | 427/247 |
| 5,683,749 | 11/1997 | DuBois et al. | 427/243 |

FOREIGN PATENT DOCUMENTS 0 846 789 6/1998 European Pat. Off. .

OTHER PUBLICATIONS

TAM Ceramics Inc., Product Data Sheet, ZIROX® Miled Monoclinic Zirconia, Literature No. 33B, 2 pages. No Month/Year Available.

McCutcheons's 1996, vol. 1: *Emulsifiers & Detergents,* MC Publishing Company, McCutcheon's Division, Glen Rock, New Jersey, pp. 264–275. No Month Available.

*Primary Examiner*—Bruce F. Bell

*Attorney, Agent, or Firm*—James R. Franks; Irwin M. Stein

[57] ABSTRACT

A method of forming a liquid-permeable asbestos-free diaphragm on a cathode structure is described. The method comprises forming a liquid-permeable diaphragm base mat comprising fibrous synthetic polymeric material, e.g., polytetrafluoroethylene, on a cathode structure, e.g., a foraminous cathode; drawing a liquid slurry comprising an aqueous medium containing a wetting amount of surfactant and water-insoluble inorganic particulate material through the base mat, thereby to deposit said inorganic particulate material on and within the pre-formed base mat; and drying the resultant diaphragm at temperatures less than the temperature at which decomposition by-products of the surfactant are formed. The liquid slurry is substantially free of alkali metal halide and alkali metal hydroxide; and the inorganic particulate material comprises at least one oxide or silicate of a valve metal, e.g., zirconium oxide, having a median diameter of 0.1 to 5 micrometers, and optionally clay mineral and/or hydrous oxide of zirconium and/or magnesium. In a further embodiment of the present invention, the base mat is dried prior to deposition of the inorganic particulate material.

20 Claims, No Drawings

DIAPHRAGM FOR ELECTROLYTIC CELL

DESCRIPTION OF THE INVENTION

The present invention relates to an improved method of forming a liquid-permeable asbestos-free diaphragm. A diaphragm base mat is formed on a cathode structure, and inorganic material is deposited on and within the base mat. Diaphragms made by the method of the present invention are useful in electrolytic cells, e.g., cells used to electrolytically convert aqueous alkali metal halide to aqueous alkali metal hydroxide and halogen. The present invention also relates to diaphragms made by such methods.

The electrolysis of alkali metal halide brines, such as sodium chloride and potassium chloride brines, in electrolytic cells is a well known commercial process. Electrolysis of such brines results in the production of halogen, hydrogen and aqueous alkali metal hydroxide. In the case of sodium chloride brines, the halogen produced is chlorine and the alkali metal hydroxide is sodium hydroxide. The electrolytic cell typically comprises an anolyte compartment containing an anode, and a separate catholyte compartment containing a cathode assembly. The cathode assembly is typically comprised of a cathode and a liquid-permeable diaphragm, which partitions the electrolytic cell into the anolyte and catholyte compartments.

The electrolysis of brine typically involves charging an aqueous solution of the alkali metal halide salt, e.g., sodium chloride brine, to the anolyte compartment of the cell. The aqueous brine percolates through the liquid permeable diaphragm into the catholyte compartment and then exits from the cell. With the application of direct current electricity to the cell, halogen gas, e.g., chlorine gas, is evolved at the anode, hydrogen gas is evolved at the cathode and aqueous alkali metal hydroxide is formed in the catholyte compartment from the combination of alkali metal ions with hydroxyl ions.

For the cell to operate properly it is required that the diaphragm, which partitions the anolyte and catholyte compartments, be sufficiently porous to allow the hydrodynamic flow of brine through it, while at the same time inhibiting the back migration of hydroxyl ions from the catholyte compartment into the anolyte compartment. The diaphragm should also (a) inhibit the mixing of evolved hydrogen and chlorine gases, which can pose an explosive hazard, and (b) possess low electrical resistance, i.e., have a low IR drop. Historically, asbestos has been the most common diaphragm material used in these so-called chlor-alkali electrolytic diaphragm cells. Subsequently, asbestos in combination with various polymeric resins, particularly fluorocarbon resins (the so-called polymer-modified asbestos diaphragms), have been used as diaphragm materials.

Due in part to possible health and safety issues associated with air-borne asbestos fibers in other applications, the development of asbestos-free diaphragms for use in chlor-alkali electrolytic cells has been an area of ongoing investigation. Such diaphragms, which are often referred to as synthetic diaphragms, are typically fabricated from non-asbestos fibrous polymeric materials that are resistant to the corrosive environment of the operating chlor-alkali cell. Such materials are typically perfluorinated polymeric materials, e.g., polytetrafluoroethylene (PTFE). These synthetic diaphragms may also contain various other modifiers and additives, such as inorganic fillers, pore formers, wetting agents, ion-exchange resins and the like. Examples of U.S. patents describing synthetic diaphragms include U.S. Pat. Nos. 4,036,729, 4,126,536, 4,170,537, 4,170,538, 4,170,539, 4,210,515, 4,606,805, 4,680,101, 4,853,101 and 4,720,334.

It is known that synthetic diaphragms for chlor-alkali cells having improved performance can be prepared by coating and/or impregnating them with inorganic materials. However, the surface of such coated diaphragms can be less than uniform. In some instances, the diaphragm has a mud-cracked appearance, which may result in lower than desired electrolytic cell efficiencies, e.g., low caustic efficiencies in the case of chlor-alkali cells. In addition, the use of such coated diaphragms can also lead to foaming in the anolyte compartment during start-up of a chlor-alkali cell. The occurrence of foaming can be so severe as to occlude the chlorine gas removal conduit of the anolyte compartment and result in a build-up of back pressure therein. If great enough, this build-up of back pressure can result in a total shut-down of the cell. The shut-down of a chlor-alkali cell, or a bank of such cells, is economically undesirable, particularly with regard to the increased production costs associated with such a shut-down.

It would be desirable to develop a method of forming a liquid-permeable asbestos-free diaphragm that has a uniform surface, and which provides improved operating efficiencies when used in an electrolytic cell for the production of halogen and alkali metal hydroxide. In addition, it would be desirable that the use of diaphragms prepared by such new methods would result in minimal or no foaming upon chlor-alkali cell start-up.

U.S. Pat. No. 5,188,712 describes a liquid-permeable diaphragm for use in an electrolytic chlor-alkali cell, which is made of a fibrous material upon which is deposited a first topcoat of water-insoluble, inorganic, particulate refractory material and zirconia fibers. The topcoated diaphragm is impregnated with water-soluble, hydrolyzable inorganic zirconium-containing compound that is subsequently hydrolyzed. The resulting topcoated and impregnated diaphragm is then dried. The '712 patent describes co-deposition of refractory and fibrous materials from an aqueous slurry.

U.S. Pat. No. 5,683,749 describes a method for preparing asbestos-free diaphragms for chlor-alkali electrolytic cells. The diaphragm of the '749 patent is prepared by treating a diaphragm base mat with aqueous alkali metal hydroxide, providing a coating of inorganic particulate material on the treated base mat before the base mat has dried, and drying the resultant coated diaphragm.

U.S. Pat. No. 5,612,089 describes a method for forming an electrolyte-permeable asbestos-free diaphragm. The diaphragm of the '089 patent is formed by drawing through a wet diaphragm base mat a liquid slurry comprising inorganic particulate material dispersed in aqueous alkali metal halide brine containing a wetting amount of surfactant, and drying the coated diaphragm at temperatures below the sintering or melting temperature of the synthetic polymeric material of the base mat.

Each of U.S. Pat. Nos. 5,188,712, 5,683,749 and 5,612,089 describe the use of inorganic particulate materials having a mass based median equivalent spherical diameter of from 0.5 to 10 micrometers.

In accordance with the present invention there is provided, a method of forming a liquid-permeable asbestos-free diaphragm on a cathode structure for use in an electrolytic cell, comprising:

(a) forming on said cathode structure a liquid-permeable diaphragm base mat of asbestos-free material comprising fibrous synthetic polymeric material resistant to the environment of said electrolytic cell;

(b) drawing through said diaphragm base mat a liquid slurry comprising an aqueous medium and water-insoluble inorganic particulate material comprising:

(i) at least one oxide or silicate of a valve metal having a mass based median equivalent spherical diameter of from 0.1 micrometers to 5 micrometers, and optionally at least one further inorganic material selected from the group consisting of:

(ii) clay mineral, and (iii) hydrous oxide of at least one of the metals zirconium and magnesium, said aqueous medium being substantially free of alkali metal halide and alkali metal hydroxide, and containing a wetting amount of organic surfactant selected from the group consisting of nonionic, anionic and amphoteric surfactants, and mixtures of said surfactants, thereby to deposit inorganic material on and within said diaphragm base mat; and (c) drying the resultant diaphragm at a temperature less than the temperature at which decomposition by-products of said surfactant are formed.

In accordance with the present invention there is further provided a method of forming a liquid-permeable asbestos-free diaphragm, as described above, wherein the diaphragm base mat that is formed in step (a) is dried prior to step (b). The method of the present invention is performed preferably in a sequential step wise manner.

Other than in the operating examples, or where otherwise indicated, all numbers expressing quantities of ingredients or reaction conditions used in the specification and claims are to be understood as modified in all instances by the term "about."

DETAILED DESCRIPTION OF THE INVENTION

The liquid slurry drawn through the diaphragm base mat formed in step (a) of the method of the present invention comprises an aqueous medium and water-insoluble inorganic particulate material. The aqueous medium contains a wetting amount of organic surfactant, and is substantially free of alkali metal halide, e.g., sodium chloride, and alkali metal hydroxide, e.g., sodium hydroxide. By "wetting amount" is meant that amount of organic surfactant that is at least sufficient to wet the diaphragm base mat during the deposition of the inorganic material on and within the base mat. By "substantially free" is meant that the alkali metal halide and alkali metal hydroxide are present in amounts less than that which would interfere with the effectiveness of the wetting amount of surfactant.

The presence of alkali metal halide, e.g., sodium chloride, in the aqueous medium can reduce the solubility of the organic surfactant within the aqueous medium, thereby requiring the use of more surfactant to achieve wetting of the base mat and contributing to the foaming problem. This is particularly true when the organic surfactant is a nonionic surfactant. The presence of alkali metal hydroxide within the aqueous medium can result in chemical degradation and reduced solubility of the organic surfactant. It is contemplated that the amount of alkali metal halide and alkali metal hydroxide present in the aqueous medium of the drawn slurry will total no more than 5 percent by weight, for example less than 1 percent by weight. In a preferred embodiment of the present invention, the aqueous medium of the drawn slurry is obtained from a source of either de-ionized or distilled water and is free of alkali metal halide and alkali metal hydroxide.

According to the method of the present invention, after the liquid slurry has been drawn through the diaphragm base mat formed in step (a), the resultant diaphragm is dried at a temperature less than the temperature at which decomposition by-products of the organic surfactant are formed. While not intending to be bound by any theory, it is believed that surfactant decomposition by-products can contribute to foaming problems, as previously described herein, when synthetic diaphragms containing such by-products are used in chlor-alkali cells. The exact nature of these decomposition by-products has not been determined definitively. In the case of certain nonionic surfactants, there has been some indication, as ascertained by infrared analysis, that the decomposition by-products include esters of indeterminate composition. However, minimal foaming has been observed in the operation of electrolytic chlor-alkali cells in which diaphragms prepared in accordance with the present invention are used.

The temperature or range of temperatures used to dry the resultant diaphragm according to the method of the present invention will depend on the nature of the surfactant(s) used. Typically, the drying temperature of step (c) is at least 40° C., preferably at least 45° C., and more preferably at least 50° C. Also, the temperature at which the resultant diaphragm is dried is typically less than 100° C., preferably less than 80° C., and more preferably less than 75° C. The temperature at which the resultant diaphragm is dried in step (c) of the method of the present invention may range between any combination of these values, inclusive of the recited values.

Drying is typically conducted over a period of time sufficient to result is substantial removal of water from the diaphragm. Generally, drying is conducted in an air circulating oven over a period of 3 to 20 hours. To assist in the drying of the diaphragm, air is typically pulled through the diaphragm by attaching it to a vacuum system. As the diaphragm dries and becomes more porous, the vacuum is usually observed to drop. Initial vacuums of from 1 inch (25 mm) of mercury to 20 inches (508 mm) of mercury may be used.

While drying temperatures less than 40° C. may be used in the method of the present invention, the time to achieve an adequate level of drying can be excessive, e.g., in excess of 24 or 48 hours. In addition, while drying temperatures in excess of 100° C. may be used in the method of the present invention when coupled with a short drying time, e.g., as with a flash drying process, the level of drying can be inadequate and the formation of surfactant decomposition by-products is still likely. In the method of the present invention, drying temperatures of less than 40° C. and in excess of 100° C. are generally not preferred.

The water-insoluble inorganic particulate material of the liquid slurry drawn through the diaphragm base mat comprises at least one oxide or silicate of a valve metal ("valve metal-oxide/silicate"). As used herein and in the claims, by "valve metal" is meant vanadium, chromium, zirconium, niobium, molybdenum, hafnium, tantalum, titanium, tungsten and mixtures thereof. Zirconium-containing materials, such as zirconium oxide and zirconium silicate, and mixtures thereof are preferred. Zirconium oxide is particularly preferred in the method of the present invention.

The valve metal-oxide/silicate useful in the present invention has a mass based median equivalent spherical diameter of at least 0.1 micrometers, preferably at least 0.5 icrometers, and more preferably at least 1.0 micrometers. The valve metal-oxide/silicate also has a mass based median equivalent spherical diameter of not more than 5 micrometers, preferably not more than 4 micrometers and more preferably not more than 3 micrometers. The mass based median equivalent spherical diameter of the valve metal-oxide/silicate can range between any combination of these values, inclusive of the recited values. It is to be understood that although the median particle size of the valve metal-oxide/silicate will be found within these ranges, individual size fractions with diameters up to 40 micrometers and down to or less than 0.1 micrometers (microns) may be represented in the distribution of particle sizes.

While not intending to be bound by any theory, and based on the information at hand, it is believed that the small mass based median equivalent spherical diameter of the valve metal-oxide/silicate provides the uniform surface of the liquid-permeable asbestos-free diaphragms prepared by the method of the present invention. It is further believed that the small particle size of the valve metal-oxide/silicate allows them to penetrate deeper into and be laid down more uniformly upon the diaphragm base mat.

When used in combination with clay mineral (ii) and/or hydrous oxide of at least one of the metals zirconium and magnesium (iii), the valve metal-oxide/silicate (i) is present in the slurry in an amount of at least 50 percent by weight, preferably at least 60 percent by weight, and more preferably at least 70 percent by weight, based on the total dry weight of (i), (ii) and (iii). The valve metal-oxide/silicate (i) is also present in the slurry in an amount of less than 98 percent by weight, preferably less than 90 percent by weight, and more preferably less than 85 percent by weight, based on the total dry weight of (i), (ii) and (iii).

In addition to the valve metal-oxide/silicate (i), the inorganic particulate material may optionally comprise clay mineral (ii). Clay minerals, which are naturally occurring hydrated silicates of iron, magnesium and aluminum, that may be used include, but are not limited to, kaolin, meerschaums, augite, talc, vermiculite, wollastonite, montmorillonite, illite, glauconite, attapulgite, sepiolite and hectorite. Of the clay minerals, attapulgite and hectorite and mixtures thereof are preferred for use in the method of the present invention. Such preferred clays are hydrated magnesium silicates and magnesium aluminum silicates, which may also be prepared synthetically. The mean particle size of the clay mineral may vary, but is typically less than 5 micrometers, for example 1 micrometer.

When used in the method of the present invention, the clay mineral (ii) is typically present in the slurry in an amount of at least 1 percent by weight, preferably at least 5 percent by weight, and more preferably at least 10 percent by weight, based on the total dry weight of valve metal-oxide/silicate (i), clay mineral (ii) and hydrous oxide of at least one of the metals zirconium and magnesium (iii). The clay mineral is also typically present in the slurry in an amount of less than 45 percent by weight, preferably less than 30 percent by weight, and more preferably less than 20 percent by weight, based on the total dry weight of (i), (ii) and (iii). The amount of clay mineral used, may range between any combination of these values, inclusive of the recited values.

The inorganic particulate material may further optionally comprise, in addition to the valve metal-oxide/silicate (i), hydrous oxide of at least one of the metals zirconium and magnesium (iii). Of these hydrous oxides, magnesium hydroxide is particularly preferred. The mean particle size of the hydrous oxide may vary, but is typically less than 10 microns. In a preferred embodiment of the present invention, a hydrous oxide of magnesium is used, i.e., magnesium hydroxide, having a mean particle size of 4 microns and with a 98 percent fraction passing through a 325 mesh screen.

When used in the method of the present invention, the hydrous oxide of at least one of the metals zirconium and magnesium (iii) is present in the slurry in an amount of at least 1 percent by weight, preferably at least 3 percent by weight, and more preferably at least 5 percent by weight, based on the total dry weight of valve metal-oxide/silicate (i), clay mineral (ii) and hydrous oxide (iii). The hydrous oxide of at least one of the metals zirconium and magnesium (iii) is also typically present in the slurry in an amount of less than 45 percent by weight, preferably less than 25 percent by weight, and more preferably less than 15 percent by weight, based on the total dry weight of (i), (ii) and (iii). The amount of hydrous oxide of at least one of the metals zirconium and magnesium used, may range between any combination of these values, inclusive of the recited values.

In a preferred embodiment of the present invention, the inorganic particulate material comprises a combination of all three inorganic materials (i), (ii) and (iii). In this case, the inorganic materials (i), (ii) and (iii) are together present in amounts as recited previously herein. In a particularly preferred embodiment of the present invention, the valve metal-oxide/silicate (i) is present in an amount of from 70 percent by weight to 80 percent by weight, the clay mineral (ii) is present in an amount of from 10 percent to 20 percent by weight, and the hydrous oxide of at least one of the metals zirconium and magnesium (iii) is present in an amount of from 5 percent to 10 percent by weight, such weights being based on the total dry weight of (i), (ii) and (iii).

The amount of inorganic particulate material present in the liquid slurry that is drawn through the diaphragm base mat formed in step (a) can vary over a wide range, depending on, for example, how much inorganic material is desired to be deposited on and within the base mat. Typically, the slurry contains inorganic material present in an amount of from 1 to 15 grams per liter of aqueous medium (gpl), e.g., 1 to 10 or 3 to 5 gpl. The density of inorganic material deposited on and within the base mat is typically from 0.01 to 0.1 pounds per square foot (0.05 to 0.5 kg/square meter), e.g., 0.05 pounds per square foot (0.24 kg/square meter).

The aqueous medium of the slurry also contains a wetting amount of organic surfactant as discussed previously herein. More specifically, the organic surfactant is typically present in the aqueous medium in an amount of at least 0.01 percent by weight, preferably at least 0.02 percent by weight, and more preferably at least 0.05 percent by weight, based on the total weight of the water comprising the aqueous medium. The organic surfactant is also typically present in an amount of less than 1 percent by weight, preferably less than 0.5 percent by weight, and more preferably less than 0.3 percent by weight, based on the total weight of the water comprising the aqueous medium. The amount of organic surfactant present in the aqueous medium of the slurry drawn through the diaphragm base mat formed in step (a) may range between any combination of these values, inclusive of the recited values.

Organic surfactants from which the organic surfactant may be selected include, but are limited to, those represented by the following general formula I, $$R—(OC_2H_4)_m—(OC_3H_6)_n—(OC_4H_8)_p—R_1 \qquad \text{I}$$

Depending on the composition of the end group $R_1$, general formula I may represent either nonionic or anionic surfactants. With reference to general formula I, R is an aliphatic hydrocarbon group, which preferably contains from 6 to 20 carbon atoms, more preferably from 8 to 15 carbon atoms, $—(OC_2H_4)_m—$ represents a poly(ethylene oxide) group, —$(OC_3H_6)_n$— represents a poly(propylene oxide) group, —$(OC_4H_8)_p$— represents a poly(butylene oxide) group, $R_1$ is the terminal group, which may be hydroxyl, chloride, $C_1$–$C_3$ alkyl, $C_1$–$C_5$ alkoxy, benzyloxy (—$OCH_2C_6H_5$), phenoxy, phenyl ($C_1$–$C_3$)alkoxy, —$OCH_2C(O)OH$, sulfate, sulfonate or phosphate and the letters m, n and p are each an average number of from 0 to 50, provided that the sum of m, n and p is between 1 and 100

When $R_1$ is —$OCH_2C(O)OH$, sulfate, sulfonate or phosphate, general formula I represents an anionic surfactant, in particular when these groups are present as salts. Salts of such terminal $R_1$ groups may be formed in the presence of a base, including for example, alkali metal hydroxide, e.g., sodium hydroxide, organic amine, e.g., triethylamine, and alkanolamine, e.g., mono-, di-, or triethanolamine.

Preferably, in general formula I, m, n and p are each a number of from 0 to 30, with the sum thereof being from 1 to 30; more preferably, m, n and p are each a number of from 0 to 10, with the sum thereof being from 1 to 20, more preferably from 1 to 10. Most preferably, n and p are 0, and $R_1$ is hydroxyl, i.e., the surfactants are ethoxylated aliphatic hydrocarbon materials, e.g., alcohols, i.e., alkanols. The aforedescribed surfactant materials are known to those skilled in the surfactant art and are either available commercially or can be synthesized by known synthesis procedures using commercially available starting materials.

Other surfactant materials that may be used in the method of the present invention include those surfactants that may be represented by formula I, wherein R is the group $(R')_t$—Ph—, wherein R' is an alkyl group containing from 5 to 20 carbons, e.g., 6 to 12 carbon atoms, Ph represents the bivalent or trivalent phenylene group, and the letter t is the integer 0 to 2, preferably 1 or 2.

Further nonionic surfactant materials contemplated for use in the method of the present invention are the copolymers of ethylene oxide and propylene oxide, e.g., ethoxylated polyoxypropylene glycols and propoxylated polyethylene glycols. These materials may be random or block copolymers having a molecular weight of from 1000 to 16,000, and may be capped. These block polyols may be represented by the general formulae II and III:

$$HO(C_2H_4O)_a(C_3H_6O)_b(C_2H_4O)_cH \quad \text{II}$$

$$HO(C_3H_6O)_b(C_2H_4O)_a(C_3H_6O)_dH \quad \text{III}$$

wherein the letter b is chosen to provide a polyoxypropylene group of at least 900 molecular weight, e.g., 900–9000 molecular weight, more preferably 950 to 3500. The letter b is therefore equal to or greater than 15. In preparing the surfactants represented by general formula II, the polyoxypropylene group, i.e., the reaction of propylene oxide with propylene glycol, is ethoxylated such that the ethoxy group represented by a and c represent from 10 to 90 percent, e.g., 25 to 50 percent, of the total weight of the polyol.

In preparing the surfactant represented by general formula III, the polyoxypropylene is ethoxylated so that the amount of ethoxy groups represent from 10 to 90 percent of the total weight of the polyol and then the polyol is capped with propylene oxide, e.g., d is a number of from 1 to 10.

Other polyols may be represented by the following general formula IV, $$X(OC_2H_4)_q(OC_3H_6)_r(OC_4H_8)_sOX \quad \text{IV}$$

wherein q, r and s are each average numbers of from 0 to 50, provided that the sum of q, r and s is between 1 and 100, and each X is hydrogen, chloride, $C_1$–$C_3$ alkyl, or benzyl. Preferably, X is hydrogen, and q, r and s are each average numbers of from 0 to 30, provided that the sum of q, r and s is between 1 and 50. An example of such nonionic surfactant materials are the PLURONIC® surfactants available from BASF Corporation.

Amphoteric surfactants are also contemplated for use in the method of the present invention. Amphoteric surfactants contain both acidic and basic hydrophilic moieties in their structure. The most commercially prominent amphoteric surfactants are derivatives of imidazoline. Examples include cocoamphopropionate (CAS# 68919-41-5, cocoamphocarboxy-propionate (CAS# 68919-41-5), cocoamphoglycinate (CAS# 68608-65-1), cocoamphocarboxyglycinate (CAS# 68647-53-0), cocoamphopropylsulfonate (CAS# 68604-73-9), and cocoamphocarboxypropionic acid (CAS# 68919-40-4).

Another group of amphoteric surfactants contemplated for use in the method of the present invention include the Betaines and derivatives thereof, such as the Sulfobetaines. Typically, the common betaines may be represented by the following general formula V,

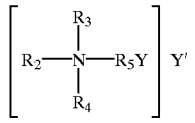

V wherein $R_2$ is an alkyl group of from 1 to 20 carbon atoms, e.g., 1–15 carbon atoms, $R_3$ and $R_4$ are each alkyl groups of from 1 to 3 carbon atoms, e.g., methyl, $R_5$ is an alkylene group of from 1 to 3 carbon atoms, Y is the anionic radical comprising the internal salts, e.g., carboxylate ion [—C(O)O—], and sulfonate ion [—$SO_2O$—], Y' is the anionic radical comprising the external salt, e.g., hydrochloride. An example of such a betaine is (carboxymethyl) dodecyldimethylammonium chloride, i.e., $[C_{12}H_{25}—N(CH_3)_2—CH_2COOH]^+Cl^-$.

Examples of the nonionic, anionic and amphoteric surfactants described herein (and their commercial sources) can be found listed in the publication, *McCutcheon's Emulsifiers and Deterrents*, Volume 1, MC Publishing Co., McCutcheon Division, Glen Rock, N.J.

Preferably, the surfactant material is a nonionic material represented by general formula I wherein R is an aliphatic hydrocarbon group containing from 8 to 15, e.g., 12–15 carbon atoms, n and p are 0, m is a number averaging from 5 to 15, e.g., 9 to 10, and $R_1$ is chloride.

The liquid-permeable diaphragm base mat formed in the first step of the method of the present invention may be made of any non-asbestos fibrous material or combination of fibrous materials known to those skilled in the chlor-alkali art, and may be prepared by art recognized techniques. Typically, chlor-alkali diaphragms are prepared by vacuum depositing the diaphragm material from a liquid, e.g., aqueous, slurry onto a permeable substrate, e.g., a foraminous cathode. The foraminous cathode is electro-conductive and may be a perforated sheet, a perforated plate, metal mesh, expanded metal mesh, woven screen, an arrangement of metal rods, or the like having equivalent openings typically in the range of from about 0.05 inch (0.13 cm) to about 0.125 inch (0.32 cm) in diameter. The cathode is typically fabricated of iron, iron alloy or some other metal resistant to the operating chlor-alkali electrolytic cell environment to which it is exposed, for example, nickel. The diaphragm material is typically deposited directly onto the cathode substrate in amounts ranging from about 0.3 to about 0.6 pound per square foot (1.5 to 2.9 kilogram per square meter) of substrate, the deposited diaphragm typically having a thickness of from about 0.075 to about 0.25 inches (0.19 to 0.64 cm).

Synthetic diaphragms used in chlor-alkali electrolytic cells are prepared predominantly from organic fibrous polymers. Useful organic polymers include any polymer, copolymer, graft polymer or combination thereof which is substantially chemically and mechanically resistant to the operating conditions in which the diaphragm is employed, e.g., chemically resistant to degradation by exposure to electrolytic cell chemicals, such as sodium hydroxide, chlorine and hydrochloric acid. Such polymers are typically the halogen-containing polymers that include fluorine. Examples of such halogen-containing polymers include, but are not limited to, fluorine-containing or fluorine- and chlorine-containing polymers, such as polyvinyl fluoride, polyvinylidene fluoride, polytetrafluoroethylene (PTFE), polyperfluoro(ethylene-propylene), polytrifluoroethylene, polyfluoroalkoxyethylene (PFA polymer), polychlorotrifluoroethylene (PCTFE polymer) and the copolymer of chlorotrifluoroethylene and ethylene (CTFE polymer). Of the halogen-containing polymers, polytetrafluoroethylene is preferred.

The organic polymer of the synthetic diaphragm is typically used in particulate form, e.g., in the form of particulates or fibers, as is well known in the art. In the form of fibers, the organic polymer material generally has a fiber length of up to about 0.75 inch (1.91 cm) and a diameter of from about 1 to 250 microns. Polymer fibers comprising the diaphragm may be of any suitable denier that is commercially available. A typical PTFE fiber used to prepare synthetic diaphragms is a ¼ inch (0.64 cm) chopped 6.6 denier fiber; however, other lengths and fibers of smaller or larger deniers may be used.

Organic polymeric materials in the form of microfibrils are also commonly used to prepare synthetic diaphragms. Such microfibrils may be prepared in accordance with the disclosure of U.S. Pat. No. 5,030,403, the disclosure of which is incorporated herein by reference. The fibers and microfibrils of the organic polymeric material, e.g., PTFE fibers and microfibrils, comprise the predominant portion of the diaphragm solids.

An important property of the synthetic diaphragm is its ability to wick (wet) the aqueous alkali metal halide brine solution which percolates through the diaphragm. To provide the property of wettability, the diaphragm of the present invention, and in particular, the diaphragm base mat, typically further comprises perfluorinated ion-exchange materials having sulfonic or carboxylic acid functional groups.

A preferred ion-exchange material is a perfluorinated material prepared as an organic copolymer from the polymerization of a fluorovinyl ether monomer containing a functional group, i.e., an ion-exchange group or a functional group easily converted into an ion-exchange group, and a monomer chosen from the group of fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro (alkylvinyl ether) with the alkyl being an alkyl group containing from 1 to 10 carbon atoms. A description of such ion-exchange materials can be found in U.S. Pat. No. 4,680,101 in column 5, line 36, through column 6, line 2, which disclosure is incorporated herein by reference.

An ion-exchange material with sulfonic acid functionality is particularly preferred. A perfluorosulfonic acid ion-exchange material (5 weight percent solution) is available from E. I. du Pont de Nemours and Company under the tradename NAFION resin. Other appropriate ion-exchange materials may be used to allow the diaphragm to be wetted by the aqueous brine fed to the electrolytic cell, as for example, the ion-exchange material available from Asahi Glass Company, Ltd. under the tradename FLEMION.

In addition to the aforedescribed fibers and microfibrils of halogen-containing polymers and the perfluorinated ion-exchange materials, the formulation used to prepare the diaphragm base mat may also include other additives, such as thickeners, surfactants, antifoaming agents, antimicrobial solutions and other polymers. In addition, materials such as fiberglass may also be incorporated into the diaphragm. An example of the components of a synthetic diaphragm material useful in a chlor-alkali electrolytic cell maybe found in Example 1 of U.S. Pat. No. 5,188,712, the disclosure of which is incorporated herein by reference.

Generally, the synthetic diaphragm contains a major amount of the polymer fibers and microfibrils. As the ion-exchange material is generally more costly than the fibers and microfibrils, the diaphragm preferably comprises from about 65 to about 90 percent by weight combined of the fibers and microfibrils and from about 0.5 to about 2 percent by weight of the ion-exchange material.

The liquid-permeable synthetic diaphragm base mat of the present invention is commonly prepared by depositing the components thereof onto the cathode, e.g., a foraminous metal cathode, of the electrolytic cell from an aqueous slurry. Typically, the components of the diaphragm base mat will be made up as a slurry in a liquid medium, such as water. The slurry used to deposit the base mat typically comprises from about 1 to about 6 weight percent solids, e.g., from about 1.5 to about 3.5 weight percent solids of the diaphragm components in the slurry, and has a pH of between about 8 and 10. The appropriate pH may be obtained by the addition of alkali metal hydroxide, e.g., sodium hydroxide, to the slurry.

The amount of each of the components comprising the diaphragm base mat may vary in accordance with variations known to those skilled in the art. With respect to the components described in the examples of the present application, and for slurries having percent solids of between 1 and 6 weight percent, the following approximate amounts (as a percentage by weight of the total slurry) of the components in the slurry used to deposit the synthetic diaphragm base mat may be used; polyfluorocarbon fibers, e.g., PTFE fibers,—from 0.25 to 1.5 percent; polyfluorocarbon microfibrils, e.g., PTFE microfibrils,—from 0.6 to about 3.8 percent; ion-exchange material, e.g., NAFION resin,—from about 0.01 to about 0.05 weight percent; fiberglass—from about 0.06 to about 0.4 percent; and polyolefin, e.g., polyethylene, such as SHORT STUFF,—from about 0.06 to about 0.3 percent. All of the aforementioned percentages are weight percentages and are based on the total weight of the slurry.

The aqueous slurry comprising the diaphragm base mat components may also contain a viscosity modifier or thickening agent to assist in the dispersion of the solids, e.g., the perfluorinated polymeric materials in the slurry. For example, a thickening agent such as CELLOSIZE® materials may be used. Generally, from about 0.1 to about 5 percent by weight of the thickening agent can be added to the slurry mixture, basis the total weight of the slurry, more preferably from about 0.1 to about 2 percent by weight thickening agent.

A surfactant may also be added to the aqueous slurry of diaphragm base mat components to assist in obtaining an appropriate dispersion. Typically, the surfactant is a non-ionic surfactant and is used in amounts of from about 0.1 to about 3 percent, more preferably from about 0.1 to about 1 percent, by weight, basis the total weight of the slurry. Particularly contemplated nonionic surfactants are chloride capped ethoxylated aliphatic alcohols, wherein the hydrophobic portion of the surfactant is a hydrocarbon group containing from 8 to 15, e.g., 12 to 15, carbon atoms, and the average number of ethoxylate groups ranges from about 5 to 15, e.g., 9 to 10. An example of such nonionic surfactant is AVANEL® N-925 surfactant.

Other additives that may be incorporated into the aqueous slurry of the diaphragm base mat forming components include antifoaming amounts of an antifoaming agent, such as UCON® 500 antifoaming compound, to prevent the generation of excessive foam during mixing of the slurry, and an antimicrobial agent to prevent the digestion of the cellulose-based components by microbes during storage of the slurry. An appropriate antimicrobial is UCARCIDE® 250, which is available from Union Carbide Corporation. Other antimicrobial agents known to those skilled in the art may be used. Antimicrobials may be incorporated into the base mat slurry in amounts of from about 0.05 to about 0.5 percent by weight, e.g., between about 0.08 and about 0.2 weight percent.

The diaphragm base mat may be deposited from a slurry of diaphragm base mat components directly upon a liquid permeable solid substrate, for example, a foraminous cathode, by vacuum deposition, pressure deposition, combinations of such deposition techniques or other techniques known to those skilled in the art. The liquid permeable substrate, e.g., foraminous cathode, is immersed into the slurry which has been well agitated to insure a substantially uniform dispersion of the diaphragm components and the slurry drawn through the liquid permeable substrate, thereby to deposit the components of the diaphragm as a base mat onto the substrate.

Typically, the slurry is drawn through the substrate with the aid of a vacuum pump. It is customary to increase the vacuum as the thickness of the diaphragm base mat layer deposited increases, e.g., to a final vacuum of 15 inches (381 mm) or 20 inches (508 mm) of mercury. The liquid permeable substrate is withdrawn from the slurry, usually with the vacuum still applied to insure adhesion of the diaphragm base mat to the substrate and assist in the removal of excess liquid from the diaphragm mat. The weight density of the diaphragm base mat typically is between about 0.35 and about 0.55 pounds per square foot (1.71–2.68 kg/square meter), more typically between about 0.38 and about 0.42 pounds per square foot (1.85–2.05 kg/square meter) of substrate. The diaphragm mat will generally have a thickness of from about 0.075 to about 0.25 inches (0.19–0.64 cm), more usually from about 0.1 to about 0.15 inches (0.25–0.38 cm).

In one embodiment of the present invention, after removal of excess liquid present on the diaphragm base mat, and while the mat is still wet, i.e., the diaphragm base mat is not permitted to dry completely, inorganic particulate material is deposited on and within the diaphragm base mat. It is the exposed face of the diaphragm base mat upon which this deposition occurs, i.e., the surface facing the anode or anolyte chamber. One surface of the diaphragm base mat is adjacent to the foraminous cathode structure and therefore, only the opposite surface of the diaphragm mat, i.e., the exposed surface, is available for deposition.

In another embodiment of the method of the present invention, the diaphragm base mat formed in step (a) is dried prior to step (b) wherein the liquid slurry comprising an aqueous medium and inorganic particulate material is drawn therethrough, as previously described herein. This additional drying step further improves the surface uniformity of the inorganic material deposited on and within the diaphragm base mat. While not intending to be bound by any theory, it believed that the additional drying step between steps (a) and (b) increases the pore size of the diaphragm base mat and allows the inorganic material to penetrate deeper and lay down more uniformly upon the base mat.

The additional drying step between steps (a) and (b) may be conducted at a temperature less than that of the sintering or melting temperature of the synthetic polymeric material of the diaphragm base mat. However, the liquid slurry from which the diaphragm base mat is formed often further comprises a surfactant, e.g., a non-ionic surfactant. As such, the temperature of the additional drying step is more typically less than the temperature at which decomposition by-products of the surfactant are formed. The temperature of the additional drying step may range between any combination of values previously recited herein with reference to drying step (c) of the method of the present invention.

The diaphragms of the present invention are liquid permeable, thereby allowing an electrolyte, such as sodium chloride brine, subjected to a pressure gradient to pass through the diaphragm. Typically, the pressure gradient in a diaphragm electrolytic cell is the result of a hydrostatic head on the anolyte side of the cell, i.e., the liquid level in the anolyte compartment will be on the order of from about 1 to about 25 inches (2.54–63.5 cm) higher than the liquid level of the catholyte compartment. The specific flow rate of electrolyte through the diaphragm may vary with the type of the cell, and how it is used. In a chlor-alkali cell the diaphragm should be able to pass from about 0.001 to about 0.5 cubic centimeters of anolyte per minute per square centimeter of diaphragm surface area. The flow rate is generally set at a rate that allows production of a predetermined, targeted alkali metal hydroxide concentration, e.g., sodium hydroxide concentration, in the catholyte, and the level differential between the anolyte and catholyte compartments is then related to the porosity of the diaphragm and the tortuosity of the pores. For use in a chlor-alkali cell, the diaphragm will preferably have a permeability similar to that of asbestos-type and polymer modified asbestos diaphragms.

EXAMPLES

The present invention is more particularly described in the examples that follow, which are intended to be illustrative only, since numerous modifications and variations therein will be apparent to those skilled in the art.

In the following examples, all reported percentages are weight percents, unless noted otherwise or unless indicated as otherwise from the context of their use. The efficiencies of the laboratory chlor-alkali electrolytic cells are "caustic efficiencies," which are calculated by comparing the amount of sodium hydroxide collected over a given time period with the theoretical amount of sodium hydroxide that would be generated applying Faraday's Law. The reported weight density of the diaphragm mat and the coatings (topcoat) deposited on such mat are based upon the dry weight per unit area of the mat and topcoat.

The diaphragms described in the following examples are by design generally too permeable to operate with a normal sodium chloride brine feed rate, i.e., they are too permeable to maintain a normal level of liquid in the cell during cell start-up and at times during cell operation. Therefore, it is common to add materials to the anolyte compartment of the cell at start-up and during cell operation in response to the cell's performance to adjust the permeability of the diaphragm so that it will operate at the desired liquid level and other operating parameters, such as low hydrogen levels in the chlorine gas and target caustic efficiencies. The addition of such materials during cell operation is commonly referred to as doping the cell.

Dopant materials are added to the anolyte compartment of the cell mixed in sodium chloride brine, usually 100 ml of such brine, which is about a 24.5 percent aqueous sodium chloride solution. In the examples, dopant materials are selected from magnesium hydroxide and ATTAGEL 50 clay.

In the examples, reported efficiencies, caustic concentration, voltage and power consumption were selected after about one week of operation or such other time when it was considered that the cell had reached semi-stable operating conditions and in order to eliminate the extraneous long term effects of the dopant materials added to the cell to control the permeability of the diaphragm.

Example 1

This example describes the preparation and evaluation of a diaphragm according to an embodiment of the present invention in which the diaphragm base mat is not dried prior to the deposition of inorganic material on and within the base mat.

Into a 4 liter plastic beaker fitted with a laboratory Greerco mixer were charged 2400 grams of de-ionized water and 14.6 grams of CELLOSIZE ER-52M hydroxyethyl cellulose. The mixer was started and 6.0 grams of a 1 Normal aqueous sodium hydroxide solution were added to adjust the pH of the contents of the beaker within the range of 8 to 10. With continued agitation, 31.1 grams of AVANEL® N-925 (90%) nonionic surfactant and 3.2 grams UCARCIDE-250 biocide were also added to the beaker. With these additions completed, the mixer was operated at 50 percent power until the viscosity of the mixture increased to avoid throwing portions of the mixture out of the beaker. After 5 minutes of such mixing, the mixer power was adjusted to 70 percent power and 31.4 grams of TEFLON Floc [¼ inch (0.64 centimeters) (cm) chopped ×6.6 denier] polytetrafluoroethylene, 7.9 grams chopped PPG DE fiberglass [6.5 micron×⅛ inch (0.32 cm)] and 7.0 grams SHORT STUFF GA-844 polyethylene fiber were added to the mixture. Subsequently, 797 grams of an aqueous suspension of TEFLON 60 polytetrafluoroethylene (PTFE) microfibrils (10% PTFE), which was prepared in accordance with the procedure described in U.S. Pat. No. 5,030,403, and 22.4 grams of NAFION® NR-05 solution (5%) perfluorosulfonic acid ion exchange material were added to the mixture. Following about 30 minutes of total mixing time, the slurry was diluted with de-ionized water to a final weight of 3600 grams to give a total suspended solids content of 3.5 weight percent, after which the mixer was stopped. The resulting slurry was aged for about 1 day, and then sparged with air for about 15 minutes just prior to use to insure uniform distribution of the contents of the slurry.

A diaphragm base mat was deposited using multiple batches of the aforedescribed slurry by drawing the slurry under vacuum through a laboratory steel screen cathode (about 3.0 inch×30 inch (7.6 cm×76 cm) in screen area) so that the fibers in the slurry filtered out on the screen, which was about ⅛ inch (0.32 cm) thick. The vacuum was gradually increased from 1 inch (25 mm) of mercury, as the thickness of the diaphragm mat increased, to about 15 (381 mm) inches of mercury over a twelve minute period. The vacuum was held at 15 inches (381 mm) of mercury for an additional 13 minutes and then the cathode was lifted from the slurry to allow the diaphragm to drain with the vacuum continued for an additional 1 hour. About 4130 ml of total filtrate was collected. The resulting diaphragm base mat was estimated to have a weight density of about 0.41 pounds/square foot (lb./sq. ft) [2.0 kg/m$^2$] (dry basis) based upon the volume of slurry drawn through the cathodic screen. The diaphragm base mat was not dried prior to topcoat application.

A topcoat slurry was prepared by dispersing ZIROX® 120 zirconium oxide powder (mass based median equivalent spherical diameter of about 1.75 microns), ATTAGEL 50 attapulgite clay powder and magnesium hydroxide in a cumulative amount of 10 grams/liter (gpl) into de-ionized water containing 1 gpl of AVANEL® N-925 (90%) nonionic surfactant. The topcoat slurry contained 77.5 percent by weight of ZIROX® 120 zirconium oxide powder, 15 percent by weight of ATTAGEL 50 attapulgite clay powder, and 7.5 percent by weight of magnesium hydroxide, percent weights being based on the total weight of zirconium oxide, clay and magnesium hydroxide.

The diaphragm base mat, while still wet, was topcoated by drawing the topcoat slurry under vacuum through the diaphragm mat. The vacuum during topcoating was increased gradually and held at 24 inches (610 mm) of mercury until the cathode was removed at 30 minutes. The topcoat weight density was estimated to be 0.08 lb./sq. ft (0.39 kg/m$^2$) (dry basis) from the 5100 ml of topcoat filtrate drawn through the cathode screen. The diaphragm was then placed in a 50° C. oven for 16 hours. A water aspirator was used to maintain air flow through the diaphragm while it was in the oven. The total diaphragm weight density (diaphragm base mat+topcoat) after drying was 0.49 lb./square foot (2.4 kg/m$^2$). The resultant diaphragm was uniform in appearance, having no visually observable indication of surface defects, such as mud-cracking.

The resulting diaphragm and cathode were placed in a laboratory chlor-alkali electrolytic cell to measure its performance. The cell had an electrode spacing of 3/16 inch (0.48 cm), and was flushed with de-ionized water overnight prior to operation. After completion of the overnight water flush, the cell was drained and filled with brine. The cell was then operated at a temperature of 194° F. (90° C.) and a current setting of 90 amperes [144 amperes/sq. ft (ASF)]. At cell start-up, brine having a pH of 5.5 was fed to the cell at a rate of 30 ml/minute.

On the fourth day of continuous operation, a 100 ml brine solution (24.5 percent by weight NaCl) containing 0.5 grams of magnesium hydroxide was added to the anolyte compartment of the cell to regulate the diaphragm permeability. The fourth day cell doping was accompanied by an adjustment of the anolyte pH to 2 by means of aqueous HCl addition.

After 8 days of continuous operation, the cell of Example 1 was observed to be operating at 3.02 volts and 97.4 percent efficiency for a power consumption of 2127 DC kilowatt hours/ton of chlorine produced (KWH/T chlorine). The concentration of sodium hydroxide produced by the cell at this time was 116 gpl. No foaming of the anolyte was observed during the start-up of the cell on the first day of operation.

Example 2

This example describes the preparation and evaluation of a diaphragm according to an embodiment of the present invention in which the diaphragm base mat is dried prior to the deposition of inorganic material on and within the base mat.

Into a 4 liter plastic beaker fitted with a laboratory Greerco mixer were charged 2400 grams of de-ionized water and 17.1 grams of CELLOSIZE ER-52M hydroxyethyl cellulose. The mixer was started and 5.0 grams of a 1 Normal aqueous sodium hydroxide solution were added to adjust the pH of the contents of the beaker within the range of 8 to 10. With continued agitation, 31.1 grams of AVANEL® N-925 (90%) nonionic surfactant and 3.2 grams UCARCIDE-250 biocide were also added to the beaker. With these additions completed, the mixer was operated at 50 percent power until the viscosity of the mixture increased to avoid throwing portions of the mixture out of the beaker. After 5 minutes of such mixing, the mixer power was adjusted to 70 percent power and 31.6 grams of TEFLON Floc [¼ inch (0.64 centimeters) (cm) chopped ×6.6 denier] polytetrafluoroethylene, 6.0 grams chopped PPG DE fiberglass [6.5 micron×⅛ inch (0.32 cm)] and 7.0 grams SHORT STUFF GA-844 polyethylene fiber were added to the mixture. Subsequently, 802.9 grams of an aqueous suspension of TEFLON 60 polytetrafluoroethylene (PTFE) microfibrils (10% PTFE), which was prepared in accordance with the procedure described in U.S. Pat. No. 5,030,403, and 22.9 grams of NAFION® NR-05 solution (5%) perfluorosulfonic acid ion exchange material were added to the mixture. Following about 30 minutes of total mixing time, the slurry was diluted with de-ionized water to a final weight of 3600 grams to give a total suspended solids content of 3.5 weight percent, after which the mixer was stopped. The resulting slurry was aged for about 1 day, and then sparged with air for about 15 minutes just prior to use to insure uniform distribution of the contents of the slurry.

A diaphragm base mat was deposited using the afore-described slurry by drawing the slurry under vacuum through a laboratory steel screen cathode (about 3.6 inch× 3.6 inch (9.1 cm×9.1 cm) in screen area) so that the fibers in the slurry filtered out on the screen, which was about ⅛ inch (0.32 cm) thick. The vacuum was gradually increased from 1 inch (25 mm) of mercury, as the thickness of the diaphragm mat increased, to about 20 inches (508 mm) of mercury over a twelve minute period. The vacuum was held at 20 inches (508 mm) of mercury for an additional 13 minutes and then the cathode was lifted from the slurry to allow the diaphragm to drain with the vacuum continued for an additional 1 hour. About 460 ml of total filtrate was collected.

While continuing to draw air through the cathode, the cathode and diaphragm base mat were both dried over a period of four hours at a temperature of 60° C. The resulting diaphragm base mat was determined to have a weight density of about 0.42 pounds/square foot (lb./sq. ft) [2.1 kg/m$^2$] (dry basis) based upon a comparison of the weights of the cathode prior both to and after deposition of the diaphragm base mat.

A topcoat slurry was prepared by dispersing ZIROX® 120 zirconium oxide powder, ATTAGEL 50 attapulgite clay powder and magnesium hydroxide in a cumulative amount of 10 gpl into de-ionized water containing 1 gpl of AVANEL® N-925 (90%) nonionic surfactant. The topcoat slurry contained 77.5 percent by weight of ZIROX® 120 zirconium oxide powder, 15 percent by weight of ATTAGEL 50 attapulgite clay powder, and 7.5 percent by weight of magnesium hydroxide, percent weights being based on the total weight of zirconium oxide, clay and magnesium hydroxide.

The dried diaphragm base mat was topcoated by drawing the topcoat slurry under vacuum through the diaphragm mat. The vacuum during topcoating was increased gradually and held at 21 inches (533 mm) of mercury until the cathode was removed at 30 minutes. The topcoat weight density was estimated to be 0.052 lb./sq. ft (0.25 kg/m$^2$) (dry basis) from the 310 ml of topcoat filtrate drawn through the cathode screen. The diaphragm was then placed in a 60° C. oven for 4 hours. A water aspirator was used to maintain air flow through the diaphragm while it was in the oven. The total diaphragm weight density (diaphragm base mat+topcoat) after drying was 0.472 lb./square foot (2.31 kg/m$^2$). The resultant diaphragm was uniform in appearance, having no visually observable indication of surface defects, such as mud-cracking.

The resulting diaphragm and cathode were placed in a laboratory chlor-alkali electrolytic cell to measure its performance. The cell had an electrode spacing of 3/16 inch (0.48 cm), and was flushed with de-ionized water overnight prior to operation. After completion of the overnight water flush, the cell was drained and filled with brine. The cell was then operated at a temperature of 194° F. (90° C.) and a current setting of 9.0 amperes [144 amperes/sq. ft (ASF)]. At cell start-up, brine having a pH of 5.5 was fed to the cell at a rate of 3 ml/minute.

During its operation, the electrolytic cell was doped as follows. After four hours of initial operation, 0.1 grams of magnesium hydroxide and 0.1 grams of ATTAGEL 50 clay were added to the anolyte compartment of the cell to regulate the diaphragm permeability. During the second, third, sixth and seventh days of continuous operation, a 100 ml brine solution (24.5 percent by weight NaCl) containing 0.1 grams of magnesium hydroxide and 0.1 grams of ATTAGEL 50 clay was added to the anolyte compartment of the cell. The second, third, sixth and seventh day cell dopings were each accompanied by adjustment of the anolyte pH to 1 by means of the drop wise addition of aqueous HCl.

After 8 days of continuous operation, the cell of Example 2 was observed to be operating at 3.00 volts and 96.4 percent efficiency for a power consumption of 2134 DC kilowatt hours/ton of chlorine produced (KWH/T chlorine). The concentration of sodium hydroxide produced by the cell at this time was 120 gpl. No foaming of the anolyte was observed during the start-up of the cell on the first day of operation.

The present invention has been described with reference to specific details of particular embodiments thereof. It is not intended that such details be regarded as limitations upon the scope of the invention except insofar as and to the extent that they are included in the accompanying claims.

We claim:

1. A method of forming a liquid-permeable asbestos-free diaphragm on a cathode structure for use in an electrolytic cell, comprising:

(a) forming on said cathode structure a liquid-permeable diaphragm base mat of asbestos-free material comprising fibrous synthetic polymeric material resistant to the environment of said electrolytic cell;

(b) drawing through said diaphragm base mat a liquid slurry comprising an aqueous medium and water-insoluble inorganic particulate material comprising:

(i) at least one oxide or silicate of a valve metal having a mass based median equivalent spherical diameter of from 0.1 micrometers to 5 micrometers, and optionally at least one further inorganic material selected from the group consisting of:

(ii) clay mineral, and (iii) hydrous oxide of at least one of the metals zirconium and magnesium, said aqueous medium being substantially free of alkali metal halide and alkali metal hydroxide, and containing a wetting amount of organic surfactant selected from the group consisting of nonionic, anionic and amphoteric surfactants, and mixtures of said surfactants, thereby to deposit inorganic material on and within said diaphragm base mat; and (c) drying the resultant diaphragm at temperatures less than the temperature at which decomposition by-products of said surfactant are formed.

2. The method of claim 1 wherein the cathode structure is a foraminous cathode structure, the liquid-permeable permeable diaphragm base mat further comprises ion-exchange material, and the fibrous synthetic polymeric material comprises perfluorinated polymeric material.

3. The method of claim 2 wherein the fibrous synthetic polymeric material comprises polytetrafluoroethylene.

4. The method of claim 1 wherein the organic surfactant is present in an amount of from 0.01 percent by weight to 1 percent by weight, based on the total weight of the water comprising the aqueous medium.

5. The method of claim 4 wherein the organic surfactant is selected from nonionic surfactants represented by the following general formula:

$$R—(OC_2H_4)_m—(OC_3H_6)_n—(OC_4H_8)_p—R_1$$

wherein R is an aliphatic hydrocarbon group containing from 8 to 15 carbon atoms; $R_1$ is hydroxyl, chloride, $C_1$ to $C_3$ alkyl, $C_1$ to $C_5$ alkoxy or phenoxy; and m, n and p are numbers of from 0 to 30, the sum of m, n and p being from 1 to 30.

6. The method of claim 7 wherein R is an aliphatic hydrocarbon group containing from 8 to 15 carbon atoms, n and p are 0, m is a number of from 5 to 15, and $R_1$ is chloride.

7. The method of claim 1 wherein the resultant diaphragm is dried in step (c) at temperatures of from 40° C. to 100° C.

8. The method of claim 1 wherein the diaphragm base mat that is formed in step (a) is dried prior to step (b).

9. The method of claim 8 wherein the formed diaphragm base mat of step (a) is dried at temperatures of from 40° C. to 100° C.

10. The liquid-permeable asbestos-free diaphragm prepared by the method of claim 8.

11. The liquid-permeable asbestos-free diaphragm prepared by the method of claim 1.

12. A method of forming a liquid-permeable asbestos-free diaphragm on a foraminous cathode structure for use in an electrolytic cell, comprising:

(a) forming on said cathode structure a liquid-permeable diaphragm base mat of asbestos-free material comprising fibrous synthetic perfluorinated polymeric material and ion-exchange material that are each resistant to the environment of said electrolytic cell;

(b) drawing through said diaphragm base mat a liquid slurry comprising an aqueous medium and water-insoluble inorganic particulate material comprising:

(i) zirconium oxide having a mass based median equivalent spherical diameter of from 0.5 micrometers to 3 micrometers, and optionally at least one further inorganic material selected from the group consisting of:

(ii) clay mineral selected from attapulgite, hectorite and mixtures of said clay minerals, and (iii) magnesium hydroxide, said aqueous medium being substantially free of alkali metal halide and alkali metal hydroxide, and containing a wetting amount of organic surfactant selected from the group consisting of nonionic, anionic and amphoteric surfactants, and mixtures of said surfactants, thereby to deposit inorganic material on and within said diaphragm base mat; and (c) drying the resultant diaphragm at a temperature less than the temperature at which decomposition by-products of said surfactant are formed.

13. The method of claim 12 wherein the fibrous synthetic perfluorinated polymeric material is polytetrafluoroethylene, and the organic surfactant is selected from nonionic surfactants represented by the following general formula:

$$R—(OC_2H_4)_m—(OC_3H_6)_n—(OC_4H_8)_p—R_1$$

wherein R is an aliphatic hydrocarbon group containing from 8 to 15 carbon atoms; $R_1$ is hydroxyl, chloride, $C_1$ to $C_3$ alkyl, $C_1$ to $C_5$ alkoxy or phenoxy; and m, n and p are numbers of from 0 to 30, the sum of m, n and p being from 1 to 30.

14. The method of claim 12 wherein the formed diaphragm base mat of step (a) is dried prior to step (b) at temperatures of from 40° C. to 100° C.

15. The liquid-permeable asbestos-free diaphragm prepared by the method of claim 14.

16. The liquid-permeable asbestos-free diaphragm prepared by the method of claim 12.

17. A method of forming a liquid-permeable asbestos-free diaphragm on a cathode structure for use in an electrolytic cell, comprising:

(a) forming on said cathode structure a liquid-permeable diaphragm base mat of asbestos-free material comprising fibrous synthetic polymeric material resistant to the environment of said electrolytic cell;

(b) drawing through said diaphragm base mat a liquid slurry comprising an aqueous medium and water-insoluble inorganic particulate material comprising:

(i) at least one oxide or silicate of a valve metal having a mass based median equivalent spherical diameter of from 0.1 micrometers to 5 micrometers, (ii) clay mineral, and (iii) hydrous oxide of at least one of the metals zirconium and magnesium, the valve metal oxide or silicate (i) being present in an amount of from 50 percent by weight to 98 percent by weight, the clay mineral (ii) being present in an amount of from 1 percent by weight to 45 percent by weight, and the hydrous oxide (iii) being present in an amount of from 1 percent by weight to 45 percent by weight, all based on the total weight of (i), (ii) and (iii), said aqueous medium being substantially free of alkali metal halide and alkali metal hydroxide, and containing a wetting amount of organic surfactant selected from the group consisting of nonionic, anionic, amphoteric surfactants, and mixtures of said surfactants, thereby to deposit inorganic material on and within said diaphragm base mat; and (c) drying the resultant diaphragm at temperatures less than the temperature at which decomposition by-products of said surfactant are formed.

18. The method of claim 17 wherein (i) is zirconium oxide, the clay mineral (ii) is selected from attapulgite, hectorite and mixtures of said clays minerals, and (iii) is magnesium hydroxide.

19. A method of forming a liquid-permeable asbestos-free diaphragm on a foraminous cathode structure for use in an electrolytic cell, comprising:

(a) forming on said cathode structure a liquid-permeable diaphragm base mat of asbestos-free material comprising polytetrafluoroethylene and ion-exchange material that is resistant to the environment of said electrolytic cell;

(b) drawing through said diaphragm base mat a liquid slurry comprising an aqueous medium and water-insoluble inorganic particulate material comprising:

(i) zirconium oxide having a mass based median equivalent spherical diameter of from 0.5 micrometers to 3 micrometers, (ii) clay mineral selected from attapulgite, hectorite and mixtures of said clay minerals, and (iii) magnesium hydroxide, the zirconium oxide (i) being present in an amount of from 50 percent by weight to 98 percent by weight, the clay mineral (ii) being present in an amount of from 1 percent by weight to 45 percent by weight, the magnesium hydroxide (iii) being present in an amount of from 1 percent by weight to 45 percent by weight, all based on the total weight of (i), (ii) and (iii), said aqueous medium being substantially free of alkali metal halide and alkali metal hydroxide, and containing from 0.01 percent by weight to 1 percent by weight, based on the total weight of the water comprising the aqueous medium of organic surfactant selected from nonionic surfactants represented by the following general formula:

$$R—(OC_2H_4)_m—(OC_3H_6)_n—(OC_4H_8)_p—R_1$$

wherein R is an aliphatic hydrocarbon group containing from 8 to 15 carbon atoms; $R_1$ is chloride, n and p are 0, and m is a number of from 5 to 15, thereby to deposit inorganic material on and within said diaphragm base mat; and (c) drying the resultant diaphragm at a temperature less than the temperature at which decomposition by-products of said surfactant are formed.

20. The method of claim 19 wherein the resultant diaphragm is dried in step (c) at temperatures of from 40° C. to 100° C.

* * * * *

UNITED STATES PATENT AND TRADEMARK OFFICE

CERTIFICATE OF CORRECTION

PATENT NO. : 6,059,944
DATED : May 9, 2000
INVENTOR(S) : Donald W. DuBois et al.

It is certified that error appears in the above-identified patent and that said Letters Patent is hereby corrected as shown below:

Column 17, claim 6,
Line 35, "claim 7" should be -- claim 5 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*